United States Patent [19]

Millat

[11] Patent Number: 4,919,433

[45] Date of Patent: Apr. 24, 1990

[54] GOLF PUTTING TRAINER

[76] Inventor: Herbert J. Millat, 6102 Rivercliff Lane, Dayton, Montgomery County, Ohio 45449

[21] Appl. No.: 406,640

[22] Filed: Sep. 13, 1989

[51] Int. Cl.[5] ..... A63B 69/36

[52] U.S. Cl. ..... 273/192; 273/188 R

[58] Field of Search ..... 273/192, 191 R, 191 A, 273/191 B, 186 R, 186 A, 188 R, 183 D

[56] References Cited

U.S. PATENT DOCUMENTS

| | | | |
|---|---|---|---|
| 2,706,635 | 4/1955 | Thomas | 273/192 |
| 2,824,742 | 2/1958 | Fortin | 273/192 |
| 3,378,262 | 4/1968 | Haley | 273/162 |
| 3,718,333 | 2/1973 | Santoro et al. | 273/192 |
| 3,963,244 | 6/1976 | Mierejewski | 273/162 |
| 4,133,535 | 1/1979 | Marsh | 273/192 |
| 4,334,684 | 6/1982 | Sterling | 273/192 |

*Primary Examiner*—George J. Marlo

*Attorney, Agent, or Firm*—Biebel, French & Nauman

[57] ABSTRACT

A portable putt training device capable of use indoors or out and useful in training for two different types of putting strokes, e.g. a pendulum style using predominantly wrist motion, and a flat or horizontal stroke using forearm motion with little wrist flexing. The device has a vertically adjustable post in a base which the user can straddle, a swinging guide arm pivoted to the base and extending upward to or beyond the top of the post, a guide track member fixed to the post constraining the guide arm to swing in a plane, and a club retainer pivotally attached to the upper end of the guide arm. The club retainer can also be pivotally attached to the upper end of the post for training of wrist action. In an alternate embodiment the post and base are replaced by a tripod which has a crossbar connecting the bottom end of two legs of the tripod, and having the low pivotal mounting for the guide arm. The guide track member is fixed across the same two legs upward from the cross bar, and the alternate pivotal mount for the shaft retainer is attached to the top of the tripod. In all cases the guide arm has a long radius between its low pivot mounting and the club retainer, so the handle of a club fitted to such retainer is guided in an almost flat arc to move the club head and face in linear fashion. The guide arm can be fitted with an upper horizontal guide track, and a lower vertically arranged guide slot allows the lower end of the guide arm to have a short vertical path of movement, thereby contraining the club shaft retainer to horizontal linear movement.

9 Claims, 5 Drawing Sheets

GOLF PUTTING TRAINER

BACKGROUND OF THE INVENTION

This invention relates to a training device for the training and practicing of the putting phase of the game of golf. Various schemes and devices have been proposed for this purpose, and these prior art proposals are characterized by their lack of differentiation between practicing and actual play, and by imprecise mechanisms which depend in their use, at least in part, upon the player-trainee's ability to keep the mechanism itself properly in position. This of course is counter-productive to the purpose of training a player to use his own standard putter in the most effective playing stroke.

U.S. Pat. No. 3,378,262 provides a single post guide which has at its bottom or foot portion a ground engaging part which is intended to fit within a complementary cavity in the bottom of a special putter. Thus, the training device is closely linked to a particular form of club; the two are available as a unit. While the club might be used alone, the intent of the patent is to use the guide and putter as a cooperating pair.

U.S. Pat. No. 4,133,535 describes and shows an elaborate guide assembly, including spaced apart standards, rails extending between the standards, and a clamp for guiding the putter shaft which includes a vertically disposed dovetail slide. The horizontal rails of the device must be aligned each time it is set up, to avoid binding of the guiding motion of the guiding carriage.

U.S. Pat. No. 3,963,244 discloses a device which is intended to be permanently attached to the putter. While this may be useful as special club, it in all likelihood is not a club which comes within the rules of the game, and this device cannot assist the player in training with a normal putter.

U.S. Pat. No. 3,718,333 discloses a device which is linked to the lower shaft of a putter near its head, and while this may provide guidance to the head, it does not train the proper motion of the hands at the club grip.

Thus, the device of the present invention is intended to allow the trainee to practice with the same club he will use in regular play, to use the device both indoors or outdoors, and to achieve proper guidance of the required hand/wrist/forearm joints to achieve a level controlled swing with the player in a proper relaxed stance.

SUMMARY OF THE INVENTION

The putt training device is lightweight, portable, capable of use indoors or out and useful in training for two different types of putting strokes, e.g. a pendulum style using predominantly wrist motion, and a flat or horizontal stroke using forearm motion with little wrist flexing. The device includes a vertically adjustable post or stanchion, a base (preferably tri-legged) which the user can straddle without interfering with his/her need to place feet close together, a swinging guide bar pivoted to the base and extending upward to or beyond the top of the post, a guide track member fixed to the post and constraining the guide arm to swing in a predetermined plane, and a club shaft retainer pivotally attached to the upper end of the guide arm. The club shaft retainer can also be pivotally attached to the upper end of the post for training of wrist action.

An alternate embodiment of the device performs the same function, but in place of the post and base, there is provided a tripod which has a crossbar connecting the bottom end of two legs of the tripod, and having the low pivotal mounting for the guide arm. The guide track member is fixed across the same two legs substantially upward from the cross bar, and the alternate pivotal mount for the shaft retainer is attached to the top of the tripod.

In either embodiment, the guide arm has a long radius between its low pivot mounting and the club shaft retainer, so the handle of a club fitted to such retainer is guided in an almost flat arc to move the club head and face in linear fashion. Further, if a linear motion of the club shaft retainer is preferred, the guide arm can be fitted with an upper horizontal guide track, as part of the constraint, and a lower vertically arranged slot which allows the lower pivot end of the guide arm to have a short vertical path of movement. Such a mechanism will constrain the club shaft retainer to horizontal linear movement.

The primary object of the invention is to provide a putting training device which is lightweight, portable, usable indoors or outdoors, and which will guide the forearm and wrist action of a user in an essentially level and straight stroke; and which can also constrain the wrists and forearms of the user to a pivotal motion of the wrist joints, while gripping a putter, to practice proper wrist action for short putting strokes which call for minimum forearm motion; to provide such a training device which is easily adjusted to the stature and arm length of a user; to provide such a training device which may be folded into a collection of components that may easily be carried by the user, as in a long pocket of a golf bag.

Other objects of the invention will be apparent from the drawings and the following detailed descriptions.

DESCRIPTION OF THE PREFERRED EMBODIMENT

Figure 2:
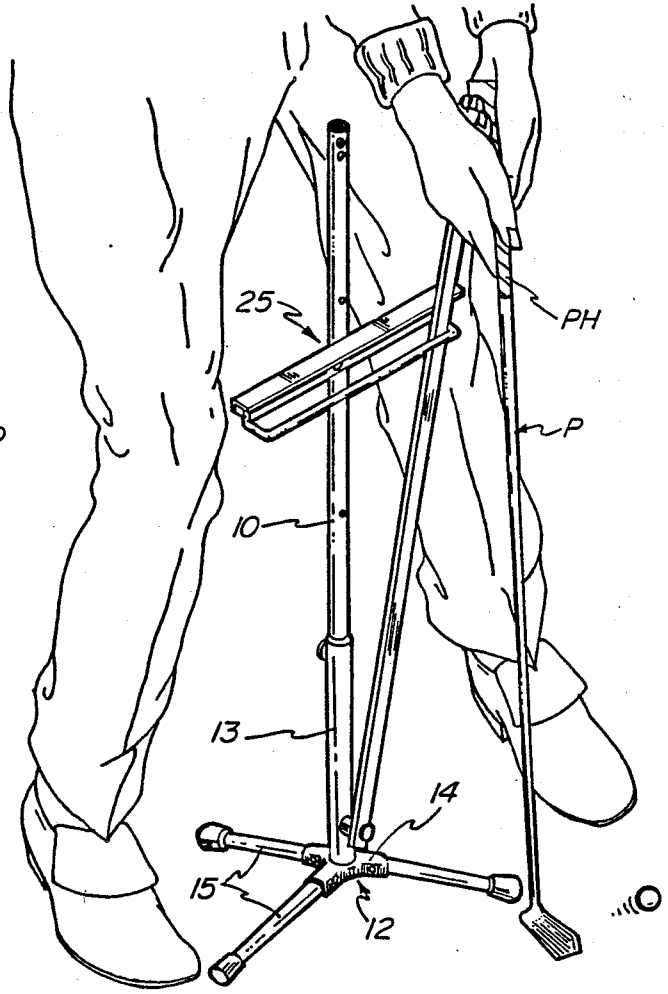
FIG. 2 is an enlarged view similar to FIG. 1, including a player straddling one leg of the base and gripping a putter which is engaged with the device.
Figure 1:
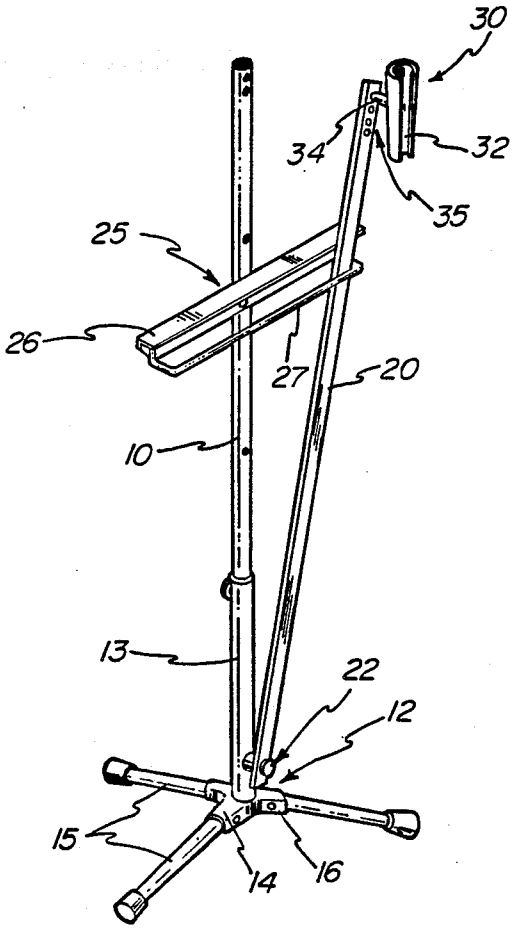
FIG. 1 is a perspective view of the preferred embodiment of the training device, without a putter included.

Referring first to FIGS. 1 and 2, the putting training device includes a vertically adjustable post or stanchion 10, a tri-legged base 12 having a central support piece 13 with three outwardly directed short arms 14 to each of which are attached legs 15, whereby one leg thereof can be straddled by the user without interfering with his/her need to place feet close together, as shown in FIG. 2. Preferably the legs 15 may be hinged into bottom opening tubular receivers 16 extending from the support piece 13, and which also provide appropriate stops limiting their motion so as to hold the central support piece slightly above the surface on which the device rests, as shown.

Figure 4:
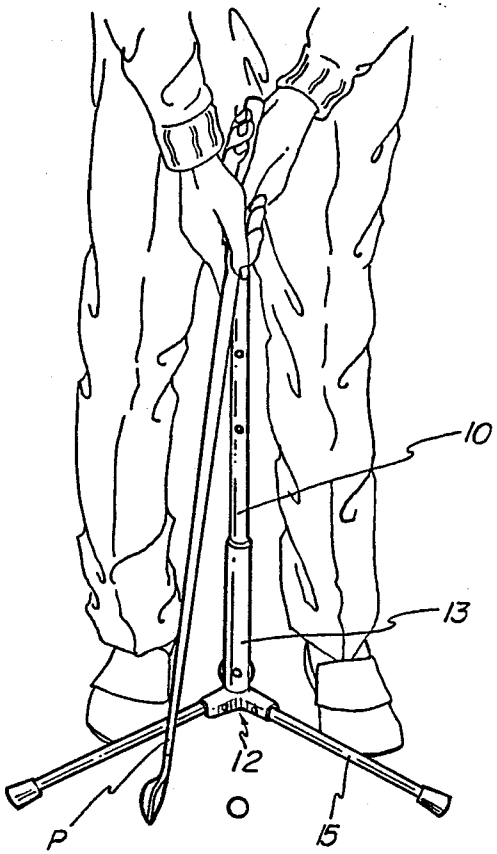
FIG. 4 illustrates use of the device as configured in FIG. 3.
Figure 3:
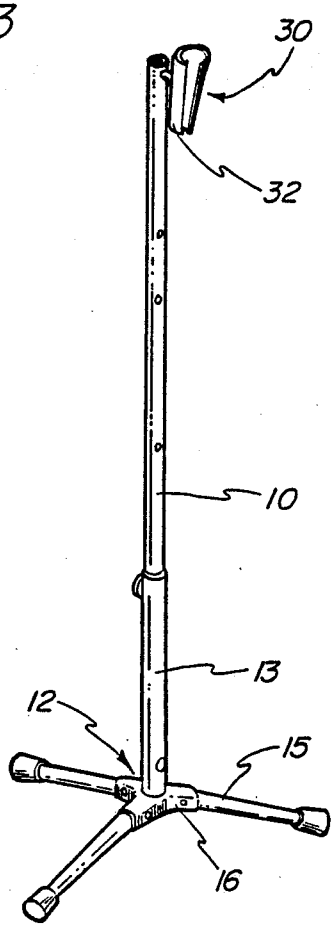
FIG. 3 is a view similar to FIG. 1 showing the device in another use for training of wrist action.
Figure 6:
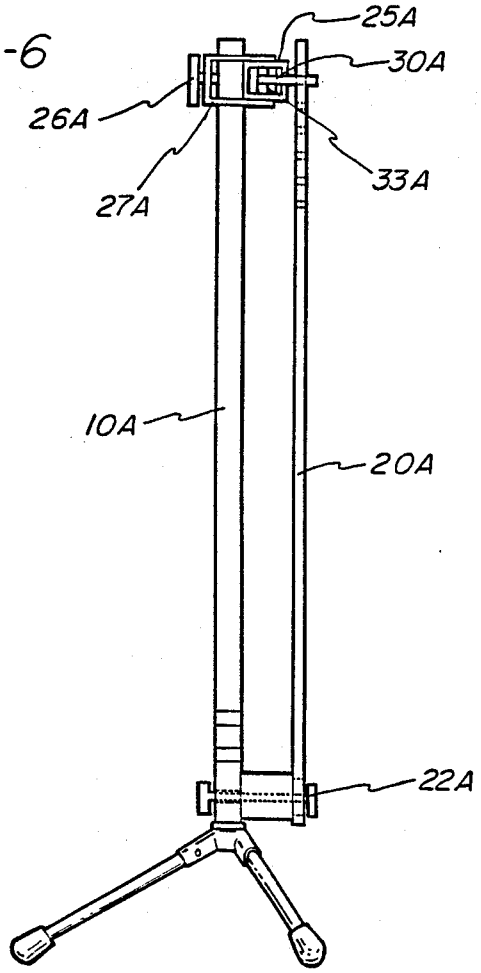
FIG. 6 is a side view of the embodiment shown in FIG. 5.

A swinging guide arm 20 is attached by a pivot joint 22 to the base, preferably to the central support, and extends upward to or beyond the top of post 10. A guide track member 25 is fixed to post 10, extending generally transversely, e.g. in a generally horizontal direction. This track member includes a base bar 26 and a bail or rod 27 fixed thereto as shown, defining a space between which the guide arm 20 is thus constraining the guide arm to swing in a predetermined generally vertical plane. A club shaft retainer 30 is pivotally attached to the upper end of guide arm 20, and comprises a generally U-shaped length of material 32 which is either malleable enough to be hand pressed around the handle PH of a putter P, or which has a compressible interior lining which performs the same function of gripping the putter handle. A pin 34 extends from retainer 30 and can be received in any one of a number of socket holes 35 in the upper end of arm 20, so the retainer is freely pivotable on arm 20. The club shaft retainer can also be pivotally attached in the same manner to the top of post 10, as shown in FIGS. 3 and 4, for training of wrist action.

A modification of the putting training device, which is useful in training a predominantly horizontal putting motion, includes a vertically adjustable post or stanchion 10A (FIG. 5) supported on a tri-legged base 12A whereby one leg thereof can be straddled by the user, as in FIG. 2. Again, the legs of base 12A may be hinged to the post 10A and include appropriate stops which limit their motion, as in the first embodiment.

A swinging guide arm 20A has a slot 21A received around a pivot pin 22A near the base, and extends upward to or beyond the top of post 10A. A horizontal guide track member 25A is fixed to post 10A near the upper end of that post, extending generally in a horizontal direction. A clamp screw 26A and bracket 27A is preferably used for this attachment, with the bracket attached to the center of track 25A and fitting around the top of post 10A, such that tightening the screw 26A against the post will pull the bracket firmly to the post, and the track can be adjusted vertically along the post.

Track member 25A faces away from the post and thus presents an open horizontal slot into which a pin 30A extends. The other end of this pin can be placed in any of several socket holes 32A along the upper end of arm 20A, and the end of pin 30A within the track is fitted with a suitable bearing 33A, such as Nylon rollers or the like. Thus, arm 20A swings about a "moving pivot" at its lower end, and its upper end is constrained to essentially horizontal motion by track member 25A.

Figure 10:
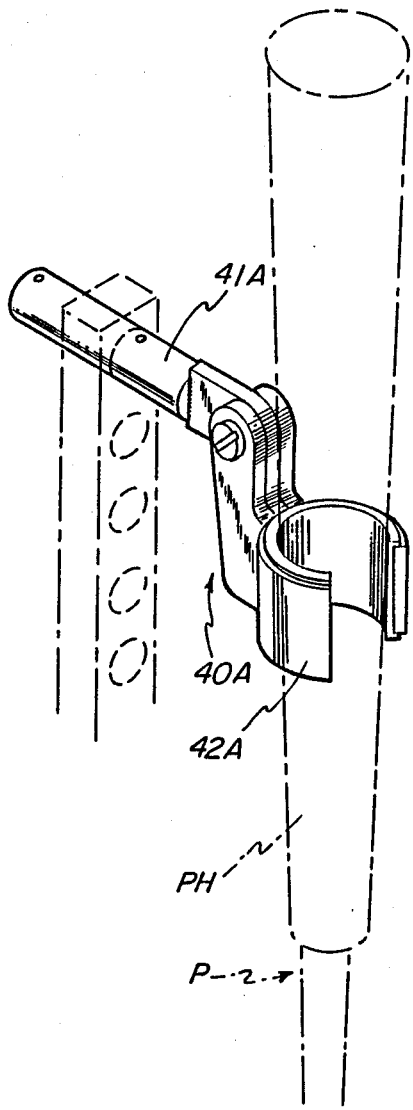
FIG. 10 is a perspective view of a form of club shaft holder.

A club shaft retainer 40A (FIG. 10) is pivotally attached to the outer end of pin 30A, as by a tubular member 41A which fits over the pin. At the end of tube 41A is a generally U-shaped length of material 42A which is either malleable enough to be hand pressed around the handle PH of a putter P, or which has a compressible interior lining which performs the same function of gripping the putter handle. It will be appreciated that the holder 40A is constrained to generally horizontal motion in this embodiment, with the slot in the bottom of arm 20A allowing the necessary motion of the lower end of the arm in this configuration.

Figure 7:
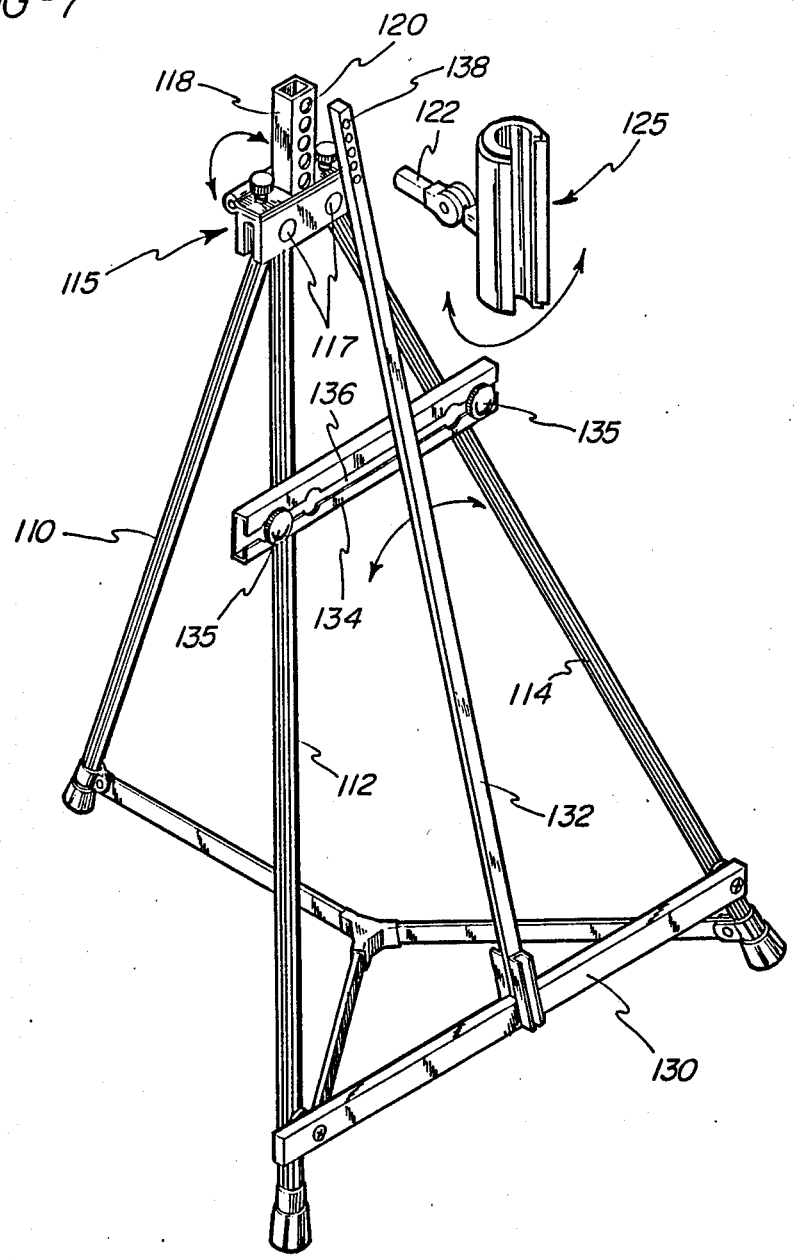
FIG. 7 is a perspective view of a third embodiment of the device.
Figure 8:
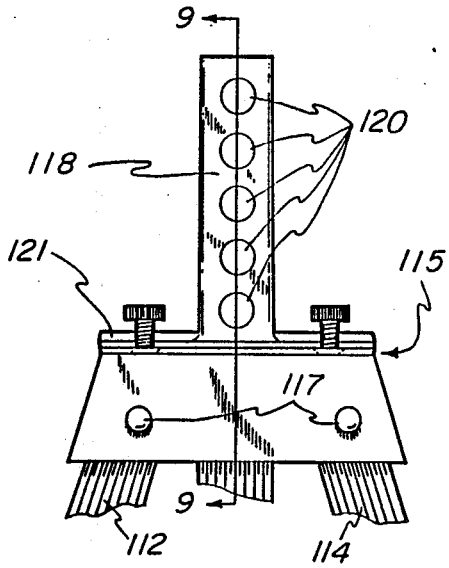
FIG. 8 is an enlarged view of a mount for the club shaft holder.

Another embodiment of the device (FIG. 7) comprises a framework in the form of a collapsible tripod having a rear leg 110 and front legs 112 and 114. It is intended that the user will straddle rear leg 110. At the top of the tripod is a head piece 115 to which the legs are hinged at 117. Extending upward from the head piece is a square tube socket member 118 with a plurality of vertically spaced horizontally facing apertures 120. These apertures are intended to receive the pivot shaft 122 of a club handle gripping retainer 125, and support the retainer for rotation about an axis extending forward of the users torso, at about waist height.

Figure 9:
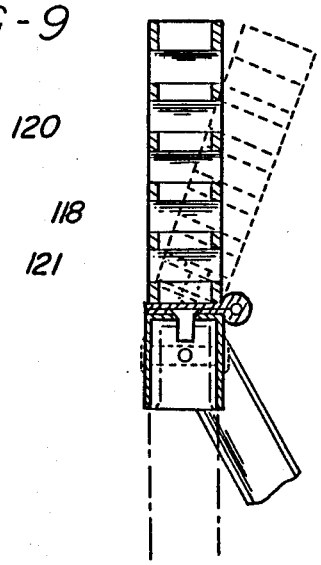
FIG. 9 is a cross-section taken on line 9—9 in FIG. 8.

Member 118 is mounted on a plate 121 hinged to head piece 115 (see FIG. 7 & 9) so it can be swung away and below the head piece when not in use. The shaft 122 can be inserted in a chosen one of the apertures 120 to regulate the height of the pivot axis for the particular user. It would also be possible to have some adjustable extension of the three legs of the tripod.

In training for a putting stroke using primarily wrist action, the golfer will insert his putter into the retainer at the center of the region on the grip which he normally uses. Then the shaft 122 is inserted into one of the apertures 120, and the club handle is gripped with one hand above and the other hand over and around clamp 125, as with a normal grip of a putter handle. This will confine the practice stroke to a generally pivoting motion of the wrists, essentially along an axis which intersects the location where the hands join or overlap, depending on the grip used by the golfer, and will inhibit arm motion in this practice regime.

Figure 5:
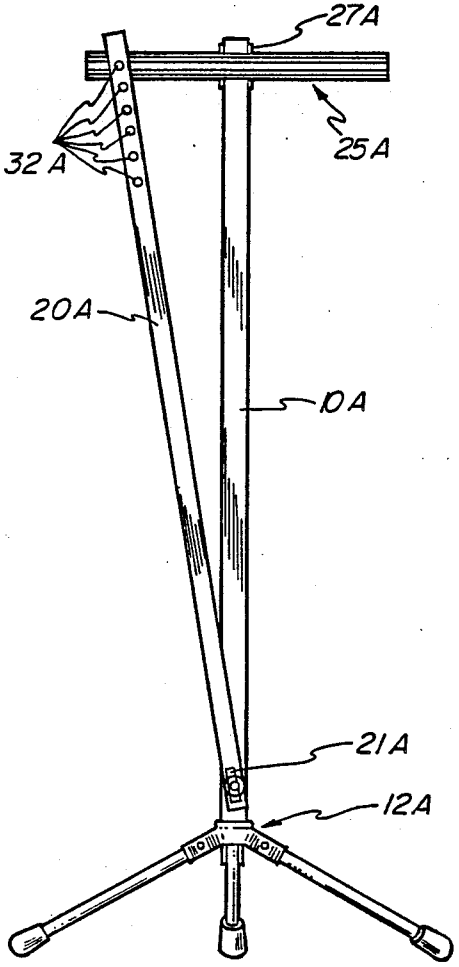
FIG. 5 is a front view of another embodiment of the device.

Extending between the front legs 112 & 114, near their bottom, is a cross-bar 130. At the center of this cross-bar there is a pivot joint attaching a guide (inverted pendulum) bar 132. This pivot connection is detachable, so the bar 132 can be removed when not in use. Near the top of legs 112 & 114 there is a stop bar 134 having a pair of horizontally adjustable stops 135 in the form of large knurled heads having a threaded shank which engages a nut that is slidable along a track 136 in bar 134. Thus, the stops can be adjusted in a horizontal direction, and tightened, to provide limits to the swinging motion of pendulum bar 132, as shown in FIG. 5.

The top of bar 132 has a plurality of apertures 138 which can also receive the shaft 122 of the clamp. In this configuration the socket member 118 can be lowered out of the way. The club handle is gripped in generally the same manner by the user, and his hands and arms are guided in a generally even stoke across the front of his body, due to the length of the pendulum bar; it will be noted that the arc traversed by the top of that bar is quite shallow.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A device for golf putting training, comprising:

a central post having upper and lower ends, a base supporting said lower end of said post holding said post in vertically extending position such that a user can stand close to said post with the user's wrists near said upper end of said post, a guide arm having upper and lower ends, said lower end having a pivot connection to said base and extending upward at least to said upper end of said post, a guide track member fixed to said upper end said post and constraining said upper end of said said guide arm to move laterally in a predetermined plane, and a club retainer pivotally attached to said upper end of said guide arm.

2. A device as defined in claim 1, wherein said base includes a central tripod connector and legs extending therefrom in an outward and downward direction, said post being supported extending upward from said connector.

3. A device as defined in said claim 2, wherein said post has a telescopic connection to said connector for vertical adjustment of said post.

4. A device as defined in claim 1, wherein said pivot connection for said guide arm includes a slot accommodating limited longitudinal motion of said guide arm, said guide arm having a bearing connection to said guide track member for constraining motion of said club retainer to linear motion.

5. A device as defined in claim 1, wherein said base includes three elongated legs connected as an elongated tripod and said post is supported at the top of said tripod, said guide track member extending between two of said legs of said tripod adjacent and spaced below said track member, a connector bar extending between said two legs at their lower ends, and a pivot support for said guide arm located at the center of said connector bar.

6. A device as defined in claim 1, wherein said guide arm is provided with a plurality of spaced holes adjacent its upper end, said club retainer including a pin receivable in a selected one of said holes to adjust the height of said club retainer along said arm.

7. A device for golf putting training, comprising a vertically adjustable post, a tri-legged base supporting said post whereby one leg thereof can be straddled by a user, a guide arm pivoted to said base and extending upward adjacent to the top of said post, a guide track member fixed to said post and constraining the guide arm to swing laterally in a predetermined plane, and a club retainer pivotally attached to the upper end of the guide arm.

8. A device as defined in claim 7, wherein said guide track member faces away from said post, a roller engaged in said track member and having a pivotable connection to said guide arm, said guide arm having an elongated slot in its lower end, and a pivot pin engaged in said slot and fastened to said base.

9. A device for golf putting training, comprising a vertically adjustable post, a tri-legged base supporting said post whereby one leg thereof can be staddled by a user, a guide arm having a sliding pivot connection to said base and extending upward adjacent to the top of said post, a guide track member fixed to said post and extending horizontally above said base, bearing means movable in said guide track member and attached to said arm constraining the guide arm to swing laterally in a predetermined plane and to constrain the upper end of said arm to a linear path, and a club shaft retainer pivotally mounted at the upper end of the guide arm.

* * * * *